US005914208A

United States Patent [19]

Fukami et al.

[11] Patent Number: 5,914,208

[45] Date of Patent: Jun. 22, 1999

[54] ELECTROPHOTOGRAPHIC PHOTOSENSITIVE MATERIAL

[75] Inventors: Toshiyuki Fukami; Nariaki Tanaka, both of Osaka; Ichiro Yamazato, Fukue; Eiichi Miyamoto, Chuo-ku; Tohru Ueno, Chu-ku; Hiroshi Mishima, Chu-ku, all of Japan

[73] Assignee: Mita Industrial Co., Ltd., Osaka, Japan

[21] Appl. No.: 09/044,005

[22] Filed: Mar. 19, 1998

[30] Foreign Application Priority Data

Mar. 21, 1997 [JP] Japan ..... 9-068029

[51] Int. Cl.[6] ..... G03G 13/22; G03G 5/04

[52] U.S. Cl. ..... 430/31; 430/56; 430/126

[58] Field of Search ..... 430/31, 56, 126

[56] References Cited

U.S. PATENT DOCUMENTS

| | | | |
|---|---|---|---|
| 4,522,483 | 6/1985 | Matsumoto et al. | 399/167 |
| 4,984,022 | 1/1991 | Matsushita et al. | 399/235 |
| 5,027,161 | 6/1991 | Kume et al. | 399/222 |
| 5,128,725 | 7/1992 | Frankel et al. | 399/347 |
| 5,359,395 | 10/1994 | Shimura et al. | 399/176 |
| 5,666,610 | 9/1997 | Tanaka et al. | 399/187 |
| 5,768,665 | 6/1998 | Yamanaka et al. | 399/235 |

FOREIGN PATENT DOCUMENTS

| | | |
|---|---|---|
| 0206933 | 12/1986 | European Pat. Off. . |
| 0475334 | 3/1992 | European Pat. Off. . |
| 0546541 | 6/1993 | European Pat. Off. . |

*Primary Examiner*—Roland Martin
*Attorney, Agent, or Firm*—Sherman & Shalloway

[57] ABSTRACT

The photosensitive material of the present invention is provided in contact with a developing roller and has a surface potential decay characteristic in which when the photosensitive material is charged to a surface potential of 800 V and is contacted with the developing roller to which a voltage (VR) is applied, the surface potential (VD) of the photosensitive material after contacting is represented by the formula (1):

$$VD \geqq 800 \times \mathrm{EXP}\ (0.00235 \times VR).$$

By using this photosensitive material, a transverse black stripe in the tip of the transfer paper is prevented and it is possible to form an image having excellent image quality and image density.

5 Claims, 4 Drawing Sheets

ELECTROPHOTOGRAPHIC PHOTOSENSITIVE MATERIAL

BACKGROUND OF THE INVENTION (1) Field of the Invention

This invention relates to an electrophotographic photosensitive material used in an image forming apparatus, and more specifically, relates to an electrophotographic photosensitive material capable of providing an image forming apparatus which can prevent the occurrence of a transverse black stripe at the tip of a transfer paper and can form an image having an excellent quality at a low cost.

(2) Description of the Prior Art

In the image formation according to electrophotography, a photosensitive material is charged uniformly, the image is exposed to form an electrostatic latent image, the latent image is developed with a toner, the toner image is transferred from the photosensitive material to a transfer paper and the toner image on the transfer paper is fixed to form an image.

Methods of development to be used include a two-component type magnetic developing method using a mixture of a toner and a magnetic carrier, a one-component type magnetic development method using a one component toner containing a magnetic powder, and a non-magnetic one-component type development method using a non-magnetic one-component type toner. In view of the cost of the developer, the cost of the developing apparatus, and the simplicity of the operation, the non-magnetic one-component type developing method is best.

In this non-magnetic one-component type development method, a charged thin layer of toner formed on a develping roller composed of an electroconductive elastomer roller is contacted with the surface of a photosensitive material having an electrostatic latent image to form a toner image. If the polarity of the electrostatic latent image (electric charge in a dark portion) is the same as the polarity of the toner, a negative image is formed by reversal development. When these polarities are different, a positive image is formed.

According to a development method using the non-magnetic one-component type toner, a fixed bias voltage is applied to the developing roller to maintain a proper image density and simultaneously to prevent fogging. For example, when a reversal development is carried out by using a positively charged type photosensitive material and a positively charged non-magnetic one-component type toner, an electric voltage having a positive polarity and having about 0.2 to 0.8 times the surface electric potential (potential in the dark portion) is applied to a developing roller.

However, at the beginning of operation of the image forming apparatus, the surface potential of the photosensitive material is zero. Thus, since the toner on the developing roller adheres to the surface of the photosensitive material, a negative voltage is applied to the developing roller to prevent the initial adhesion of the toner, the approaching of the tip of the transfer paper to the photosensitive material is sensed, and the voltage to be applied to the developing roller is switched from a negative voltage to a positive predetermined bias voltage.

However, when a negative voltage is applied to the developing roller at the time of beginning of the operation, an initial surface potential of the photosensitive material is decreased and a defect will be developed in that a transverse black stripe is generated at the tip of the transfer paper. This is presumably because an electric charge is injected from the developing roller to the photosensitive material.

To prevent this defect, means of raising the voltage stepwise are employed at the time of changing the voltage to be applied to the developing roller from a negative voltage to a positive voltage. The provision of such a controlling means makes the apparatus complex and elevates the cost, and is not preferred because the time of starting the formation of an image is delayed.

SUMMARY OF THE INVENTION

Accordingly, it is an object of this invention to provide an electrophotographic photosensitive material capable of giving an image forming apparatus which can prevent the occurrence of a transverse black stripe at the tip of the transfer paper and can be manufactured at a low cost and form an image having an excellent quality.

Another object of this invention is to provide an electrophotographic photosensitive material in which a voltage to be applied is not controlled in many steps at the time of switching off the polarity of the voltage to be applied to the developing roller, and furthermore, no delay occurs at the time of starting the formation of an image.

According to this invention, there is provided an electrophographic photosensitive material provided in contact with a developing roller, which photosensitive material has a surface potential decay characteristic in which when the photosensitive material is charged to a surface potential of 800 V and the photosensitive material is contacted with the developing roller to which a voltage (VR) is applied, the surface potential (VD) of the photosensitive material after contacting is represented by the following formula (1)

$$VD \geqq 800 \times \mathrm{EXP}\ (0.00235 \times VR) \qquad (1).$$

In the present invention, it is preferred that the above-mentioned electrophotographic photosensitive material is a positively charged organic photosensitive material, the polarity of the surface potential of the photosensitive material is positive, and the polarity of the voltage applied to the developing roller is negative.

According to this invention, there is provided a process for forming an image which comprises mainly charging the surface of a photosensitive material positively, imagewise light-exposing to form an electrostatic image on the surface of the photosensitive material, forming a negative image of the electrostatic image by a non-magnetic toner supplied to a developing roller provided in contact with the photosensitive material, and transferring the negative image to a transfer paper, wherein the photosensitive material has a surface potential decay characteristic in which when the surface of the photosensitive material is charged to 800V and is contacted with the developing roller to which a negative voltage (VR) is applied, after contacting the development roll, the surface potential (VD) of the photosensitive material is represented by the following formula (1);

$$VD \geqq 800 \times \mathrm{EXP}\ (0.00235 \times VR)$$

before forming the negative image by the non-magnetic tonor, a negative bias voltage is applied to the developing roller, and the negative image is formed by the non-magnetic toner in a condition in which a positive bias voltage is applied to the developing roller.

In such a process, the negative bias voltage (initial voltage) to be applied to the developing roller for the first time corresponds to the negative voltage (VR). The switching off of the bias voltage to be applied to the developing roller from negative to positive can be carried out by detecting the approaching of the transfer paper toward the photosensitive material.

PREFERRED EMBODIMENTS OF THIS INVENTION

This invention relates to a photosensitive material, namely an electrophotographic photosensitive material used in an image forming apparatus for developing a latent image by contacting a toner layer formed on a developing roller with the surface of the photosensitive material on which an electrostatic image is formed, which is characterized in that when the surface potential of the photosensitive material immediately before the passage of the development section is charged to 800 V, the surface potential (VD) and the voltage VR (initial voltage applied) applied to the developing roller immediately after the passage of the development section satisfy the relationship of the above formula (1).

Figure 1:
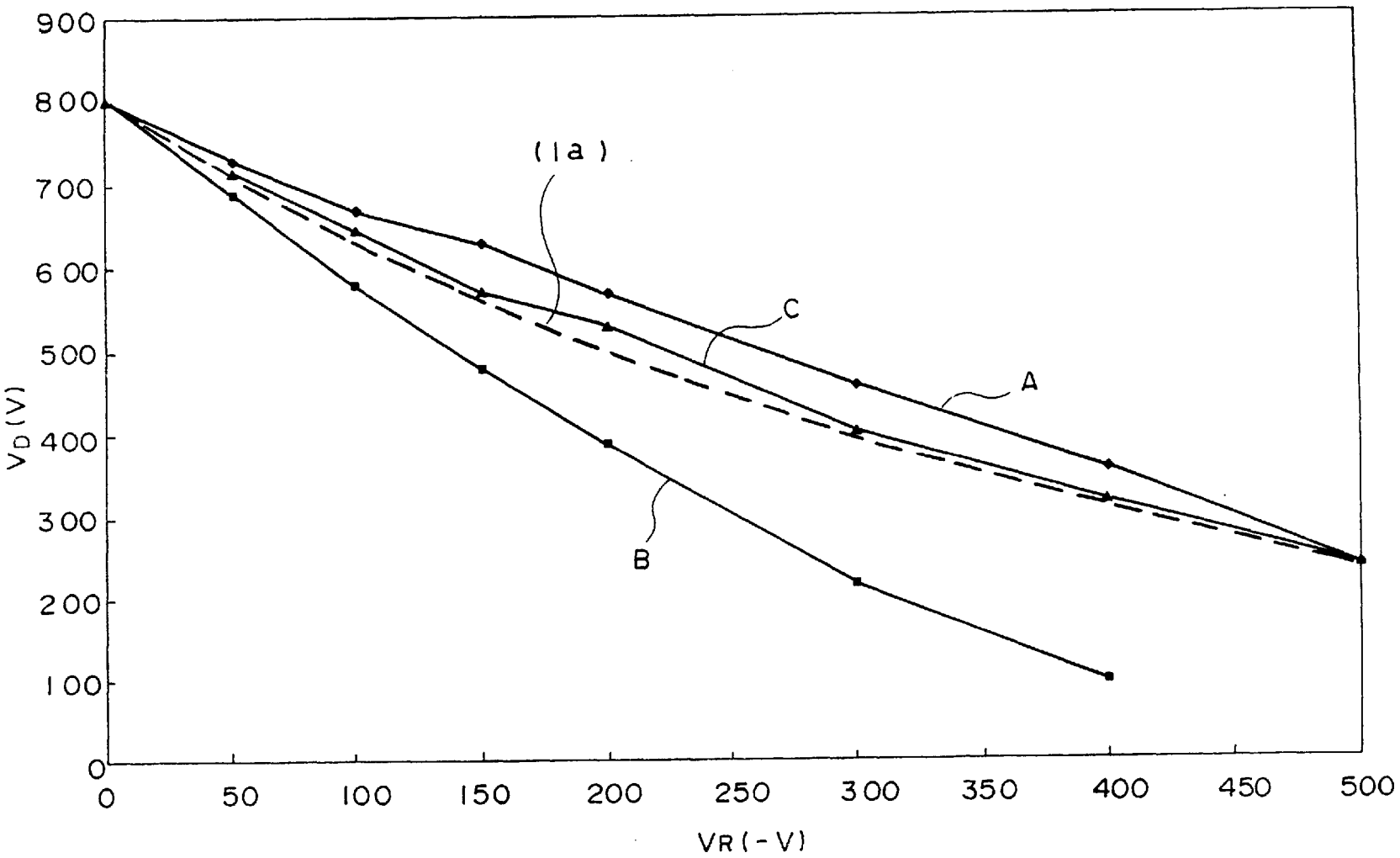
FIG. 1 is a graph showing the relationship of the initial voltage (VR) applied to the developing roller and the surface potential (VD) immediately after passage of the development section.

FIG. 1 of the attached drawings is obtained by plotting the initial voltage (VR) applied on an axis of abscissa and the surface potential (VD) immediately after passage of development section as an axis of ordinate with respect to photosensitive materials A and C (see Examples for details) of this invention and a photosensitive material B (see Examples for details) as a comparison. In FIG. 1, the curve of (1a):

$$VD=800\times\mathrm{EXP}\ (0.00235\times VR) \tag{1a}$$

is simultaneously plotted.

In the comparative photosensitive material B, a black stripe or fogging is generated on the tip of the transfer paper when the bias voltage to the developing roller is directly switched off from −200V to a predetermined +400V. On the other hand, in the photosensitive materials A and C satisfying surface potential decay characteristics, represented by the formula (1), when the bias voltage to the developing roller is directly switched off from −200V to a predetermined +400V, a black stripe or fogging is not generated, and an image having excellent quality and image density can be formed (see the Examples described below).

When generally a positively charged photosensitive material is contacted with the developing roller to which a negative bias voltage is applied, the decay of the surface potential of the photosensitive material, as clearly shown in FIG. 1, will be affected by the size of the voltage to be applied to the developing roller and simultaneously will be affected also by the ease of injection of an electric charge.

In FIG. 1, in a region above the formula (1a) satisfying the formula (1), the resistance to the injection of an electric charge from the developing roller to the photosensitive material is greater than a region below the formula (1a). This contributes critically to the prevention of a black stripe at the tip of the transfer paper which stripe occurs when the bias voltage is switched off.

When generally, the surface potential of the photosensitive material immdiately before the passage of the development section is VI, the surface potential immediately after the passage of the development section is VD, and the initial voltage applied to the developing roller is VR, the decay of the surface potential is expressed by the following formula (2)

$$VD\geqq VI\times\mathrm{EXP}\ (\alpha\times VR) \tag{2}$$

The photosensitive materials A and C satisfying the formula (1) have a value α (a coefficient showing the case of electric charge injection) of 0.00235 or below, and the comparative photosensitive material B has a value α of larger than 0.00235.

When the photosensitive material of this invention is used in an image forming apparatus for performing the development by contacting the toner layer on the development roller with the photosensitive material, it becomes possible to form an image having excellent image quality and image density by preventing the occurrence of a transverse black stripe on the tip of the transfer paper at the time of switching off the voltage to the development roller. Simultaneously, it is not necessary to control the applied voltage in many steps, and it is possible to simplify the construction of the image forming apparatus, and to curtail the cost.

[Electrophotographic photosensitive material]

The photosensitive material of this invention has surface potential decay characteristics shown by the formula (1). The surface potential decay raised here as a problem is quite different from an ordinary dark decay of the photosensitive material or the decay of potential caused by light-exposure, but occurs when a voltage of an inverse polarity to the photosensitive material is applied to the development roller in a dark condition.

As already pointed out, to achieve the surface potential decay characteristics satisfying the above formula (1), the α value (a coefficient showing the ease of electric charge injection) in the formula (2) should be adjusted to 0.00235 or below. For this purpose, when the photosensitive material is an organic photosensitive material, at least one means, preferably at least two means, must be used preferably among the following means.

(1) The thickness of the organic photosensitive material layer should be increased.

(2) The concentration of a charge generating agent in the organic photosensitive material layer should be decreased.

(3) The concentration of a charge transporting agent in the organic photosensitive material layer should be decreased.

Of course, these means shoud be employed within ranges which satisfy the following conditions. Namely, the sensitivity of the photosensitive material should not substantially be lowered, the image density should not be lowered, and the fogging density should not be increased.

In the following, organic photosensitive materials will be illustrated as examples.

The organic photosensitive material is preferably a monolayer-type organic photosensitive material obtained by dispersing a charge generating agent in a resin medium. Most preferably, it is a mono-dispersed layer type photosensitive material containing a charge transporting agent, especially a hole transporting agent and a charge generating agent, in a resin medium.

The photosensitive material of this invention may be a laminated type photosensitive material of a charge transporing layer containing a charge transporting agent and a charge generating layer containing a chage generating agent. In this case, there may also be used photosensitive materials obtained by laminating the charge generating layer (CGL) and the charge transporting layer (CTL) in this sequence or a reversed sequence.

Examples of the charge generating agent may include selenium, selenium-tellurium, amorphous silicon, pyrylium salts, azo-type pigments, disazo-type pigments, anthanthrone-type pigments, phthalocyanine-type pigments, indigo-type pigments, threne-type pigments, toluidine-type pigments, pyrazoline-type pigments, perylene-type pigments and quinacridone-type pigments. These pigments may be used singly or a mixture of at least two compounds so as to have an absorption wave region in a desired region.

Especially preferred examples are as follows.

X-type metal-free phthalocyanine and oxotitanylphthanocyanine.

Perylene-type pigments, especially those of general formula (A):

(A)

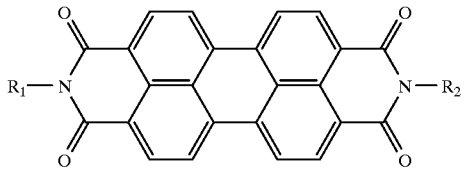

wherein each of $R_1$ and $R_2$ represents a substituted or unsubstituted alkyl group, cycloalkyl group, aryl group, alkaryl group or aralkyl group having not larger than 18 carbon atoms. Examples of the alkyl group include an ethyl group, a propyl group, a butyl group and a 2-ethylhexyl group. An example of of the cycloalkyl group is a cyclohexyl group. Examples of the aryl group include a phenyl group and a naphthyl group. Examples of the alkaryl group are a tolyl group, a xylyl group and an ethylphenyl group. Examples of the aralkyl group are a benzyl group and a phenethyl group. The substituents include an alkoxyl group and a halogen atom.

Bisazo pigment, especially those represented by the following formula (B):

(B)

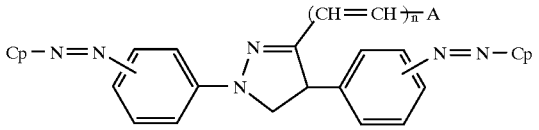

wherein A represents a hydrogen atom, a substituted or unsubstituted alkyl group, aryl group or heterocyclic group, n is 0 or 1, and $C_p$ represents a coupler residue. A substituted or unsubstituted alkyl group, aryl group or hetrocyclic group may be bonded to the 3-position of the pyrazole ring directly or via a vinylidene group. Here, examples of the alkyl group include a methyl group, an ethyl group, a propyl group, a butyl group and an amyl group. Examples of the aryl group include a phenyl group, a naphthyl group, a biphenyl group, an anthryl group, a phenanthryl group and a fluorenyl group. Examples of the heterocyclic group are monocyclic or polycyclic saturated or unsaturated heterocyclic groups containing nitrogen, oxygen or sulfur or a combination thereof in the ring, such as a thienyl group, a furyl group, an imidazolyl group, a pyrrolyl group, a pyrimidinyl group, an imidazole group, a pyrazinyl group, a pyrazolinyl group, a pyrrolidinyl group, a pyranyl group, a piperidyl group, a piperazinyl group, a morpholyl group, a pyridyl group, a pyrimidyl group, a pyrrolidinyl group, a pyrrolinyl group, a benzofuryl group, a benzimidazolyl group, a benzofuranyl group, an indolyl group, a quinolyl group, a carbazolyl group and dibenzofuranyl group. Examples of these substituents are lower alkyl groups, lower alkoxy groups, acyloxy groups, halogen atoms such as chlorine, a hydroxyl group, a nitrile group, a nitro group, an amino group, an amide group and a carboxyl group.

The coupler residue in the formula (B) may be any desired residues of couplers (azo coupling components) used in azo pigments of this type, for example, substituted or unsubstituted phenols, naphthols, or hydroxyl-containing heterocyclic compounds. Examples of the substituents include lower alkyl groups, lower alkoxyl groups, aryl groups, acyloxy groups, halogen atoms such as chlorine, a hydroxyl group, a nitrile group, a nitro group, an amino group, an amide group and a carboxyl group.

Resin media in which charge generating agents are dispersed may be various polymers, for example, olefin polymers such as a styrene type polymer, an acrylic type polymer, a styrene-acrylic type polymer, an ethylene/vinyl acetate copolymer, polypropylene and ionomers; polyvinyl chloride; a vinyl chloride-vinyl acetate copolymer; polyesters; alkyd resins; polyamides; polyurethanes; epoxy resins; polycarbonate; polyarylates; polysulfone; diallyl phthalate resins; silicone resins; ketone resins; polyvinyl butyral resins; polyether resins; phenol resins; and photocurable resins, such as epoxy acrylate. These binder resins may be used singly or as a mixture of at least two polymers. Preferred resins are styrene type polymers, acrylic polymers, styrene-acrylic type polymers, polyesters, alkyd resins, polycarbonate and polyarylates.

Especially preferred resins are polycarbonate, especially Panlight manufactured by Teijin Chemical Co., Ltd., or PCZ manufactured by Mitsubishi Gas Chemical Co., Ltd. These preferred polycarbonates are represented by the general formula (C):

(C)

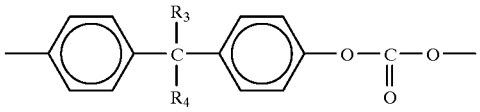

wherein $R_3$ and $R_4$ represent a hydrogen atom or a lower alkyl group, and $R_3$ and $R_4$ may be bonded to each other to form a cyclo ring such as a cycloexane ring together with the bonded carbon atom; which polymers are derived from a bisphenol and phosgene.

As charge transporting agents, any desired electron transporting or hole transporting property known per se may be used. Suitable examples are as follows.

Examples of the electron transporting agent include electron attractive substances such as para-diphenoquinone derivatives, benzoquinone derivatives, naphthoquinone derivatives, tetracyano-ethylene, tetracyanoquinodimethan, chloranil, bromanil, 2,4,7-trinitro-9-fluorenone, 2,4,5,7-tetranitro-9-fluorenone, 2,4,7-trinitro-9-dicyanomethylene-fluorenone, 2,4,5,7-tetranitroxanthone and 2,4,8-trinitrothioxanthone, and high molecular weight compounds derived from these electron attractive substances.

Among these compounds, para-diphenoquinone derivatives, especially non-symmetric type para-diphenoquinone derivatives or naphthoquinone derivatives, are preferred because they have excellent dissolving properties, and excellent electron transportability.

The naphthoquinone derivatives may be represented by the following general formula:

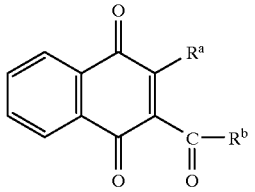

wherein $R^a$ represents an alkyl group or an aryl group which may have a substituent, and $R^b$ represents an alkyl group or an aryl group which may have a substituent, or the group —O—RG. RG in the above groups may represent an alkyl group or an aryl group which may have a substituent.

The para-diphenoquinone derivatives may be represented by the general formula (D):

(D)

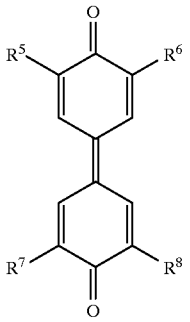

wherein each of $R^5$, $R^6$, $R^7$ and $R^8$ represents a hydrogen atom, an alkyl group, a cycloalkyl group, an aryl group, an aralkyl group or an alkoxy group. Preferably, $R^5$, $R^6$, $R^7$ and $R^8$ may be a substituent having a non-symmetrical structure. It is also preferred that among $R^5$, $R^6$, $R^7$ and $R^8$, two groups are lower alkyl groups, and the other two groups are selected from branched chain alkyl groups, cycloalkyl groups, aryl groups and aralkyl groups.

Suitable examples of the diphenoquinone derivatives are not limited to the following groups, but may include 3,5-dimethyl-3',5'-di-t-butyldiphenoquinone, 3,5-dimethoxy-3',5'-di-t-butyldiphenoquinone, 3,3'-dimethyl-5,5'-di-t-butyldiphenoquinone, 3,5'-dimethyl-3',5-di-t-butyldiphenoquinone, 3,5,3',5'-tetramethyldiphenoquinone, 2,6,2',6'-tetra-t-butyldiphenoquinone, 3,5,3',5'-tetraphenyldiphenoquinone and 3,5,3',5'-tetracyclohexyldiphenoquinone. These diphenoquinone derivatives are preferred because the symmetry of molecules is low and therefore mutual action among molecules is small, and these derivatives have excellent dissolvability.

On the other hand, the following compounds are known as the hole transporting agents. Among these compounds, those having excellent dissolvability and excellent hole transportability are used.

Pyrenes

Carbazoles such as N-ethylcarbazole, N-isopropylcarbazole, N-methyl-N-phenylhydrazino-3-methylidene-9-carbazole and N,N-diphenylhydrazino-3-methylidene-9-ethylcarbazole;

hydrazone salts such as N, N-diphenylhydrazino-3-methylidene-10-ethyl-phenothiazine, N,N-diphenylhydrazino-3-methylidene-10-ethylphenoxazine, p-diethylaminobenzaldehyde-N,N-diphenylhydrazone, p-diethylaminobenzaldehyde-α-naphthyl-N-phenylhydrazone, p-pyrrolidinobenz- aldehyde-N,N-diphenylhydrazone, 1,3,3-trimethylindolenine-ω-aldehyde-N,N-diphenylhydrazone and p-diethylbenzaldehyde-3-methylbenzthiazolinone-2-hydrazone;

2,5-bis(p-diethylaminophenyl)-1,3,4-oxadizole;

pyrazolines such as 1-phenyl-3-(p-diethylaminostyryl)-5-(pdiethylaminophenyl)pyrazoline, 1-[quinonyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxy-pyridyl(2)]-3-(p-diethylaminostyryl)-5-(p-diethylaminophenyl)-pyrazoline, 1-[pyridyl(3)]-3-(p-diethylaminostyryl)-5-(p-diethylaminophenyl)-pyrazoline, 1-[lepidyl(3)]-3-(p-diethylaminostyryl)-5-(p-diethylaminophenyl)-pyrazoline, 1-[pyridyl(2)]-3-(p-diethylaminostyryl)-4-methyl-5-(p-diethylaminophenyl)pyrazoline, 1-[pyridyl(2)]-3-(α-methyl-p-diethylaminostyryl)-3-(p-diethylaminophenyl) pyrazoline, 1-phenyl-3-(p-diethylaminostyryl)-4-methyl-5-(p-diethylaminophenyl)pyrazoline and spiropyrazoline;

oxazole type compounds such as 2-(p-diethylaminostyryl)-3-diethylaminobenzoxazole and 2-(p-diethylaminophenyl)-4-(p-dimethylaminophenyl)-5-(2-chlorophenyl)oxazole;

thiazole type compounds such as 2-(p-diethylaminostyryl)-6-diethylaminobenzothiazole;

triaryl methane type compounds such as bis(4-diethylamino-2-methylphenyl)-phenylmethan;

polyarylalkanes such as 1,1-bis(4-N,N-diethylamino-2-methyl-phenyl)heptane and 1,1,2,2-tetrakis(4-N,N-dimethylamino-2-methylphenyl)-ethane;

benzidine type compounds such as N,N'-diphenyl-N,N'-bis(methylphenyl)benzidine, N,N'-diphenyl-N,N'-bis (ethylphenyl)benzidine, N,N'-diphenyl-N,N'-bis (propylphenyl)benzidine, N,N'-diphenyl-N,N'-bis (butylphenyl)-benzidine, N,N'-bis(isopropylphenyl) benzidine, N,N'-diphenyl-N,N'-bis(secondary butylphenyl) benzidine, N,N'-diphenyl-N,N'-bis(tertiary butylphenyl) benzidine, N,N'-diphenyl-N,N'-bis(2,4-dimethylphenyl) benzidine and N,N'-diphenyl-N,N'-bis(chlorophenyl) benzidine;

phenylenediamine derivatives;

diaminonaphthalene derivatives;

diaminophenanthrene derivatives;

triphenylamine;

poly-N-vinyl carbazole;

polyvinyl pyrene;

polyvinyl anthracene;

polyvinyl acridine;

poly-9-vinylphenylanthracene;

pyrene-formaldehyde resin; and ethyl carbazole formaldehyde resin.

Preferred hole transporting agents include aromatic amine compounds represented by the following general formula (E):

(E)

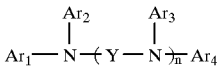

wherein each of $Ar_1$, $Ar_2$, $Ar_3$ and $Ar_4$ represents a substituted or unsubstituted aryl group, Y represents a substituted or unsubstituted arylene group, and n is zero or a number of 1.

Other preferred hole transporting agents include hydrazones, especially hydrazones expressed by the following formula (F):

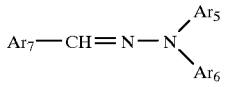

(F)

wherein each of $Ar_5$, $Ar_6$ and $Ar_7$ represents a substituted or unsubstituted aryl group.

In the mono-dispersed type photosensitive material used in this invention, the charge generating agent (CGM) may preferably be contained in the photosensitive layer as small as possible in an amount of 0.5 to 7% by weight, especially 2 to 5% by weight, based on the solid content, within the range which does not adversely affect the sensitivity on the presmise that the surface potential decay characteristics does not fall outside the range shown in the formula (1). The charge transporting agent (CTM) is preferably contained in the photosensitive layer as small as possible in an amount of 20 to 70% by weight, especially 25 to 60% by weight, based on the solid content, within the range which does not adversely affect the sensitivity.

From the respect of sensitivity or the wide extent of utility which enables reversal development, a combined use of the electron transporting agent (ET) and the hole transporting agent (HT) is preferred. In this case, the weight ratio of ET:HT is best at 10:1 to 1:10, especially 1:5 to 1:1.

It is possible to compound various known compounding agents such as an antioxidant, a radical scavenger, a singlet quencher, a UV absorbing agent, a softening agent, a surface modifying agent, a defoamer, an extender, a viscosity increasing agent, a dispersion stabilizer, a wax, an acceptor and a donor in the composition for forming a photosensitive material in ranges which do not adversely affect electrophotographic characteristics.

When a steric hindering phenol-type oxidation preventing agent is compounded in an amount of 0.1 to 50% by weight based on all solid content, the durability of the photosensitive layer can be markedly increased without adversely affecting electrophotographic characteristics.

Various materials having electroconductivity may be used as an electroconductive base plate on which a photosensitive layer is provided. Examples of these materials include single metal plates such as aluminum, copper, tin, platinum, gold, silver, vanadium, molybdenum, chromium, cadmium, titanium, nickel, indium, stainless steel and brass; plastic materials obtained by vapor-depositing or laminating these metals on plastic materials; and glass coated with aluminum iodide, tin oxide or indium oxide.

In a single layer-dispersed type photosensitive material used in this invention, an aluminum blank tube or a blank tube Alumite layer which has a thickness of 1 to 50 $\mu$m.

To form a single-dispersed type photosensitive material, a charge generating material, a charge transporting agent and a binder resin may be mixed by a conventional known method such as a roll mill, a ball mill, an attriter, a paint shaker or an ultraviolet dispersing machine, the mixture may be coated and dried.

The thickness of the photosensitive layer is not particularly limited, but should be preferably as thick as possible generally from 5 to 100 $\mu$m, especially from 10 to 40 $\mu$m, and within a range which does not decrease the sensitivity or increase the residual potential.

Various organic solvents may be used as the solvent for the coating solution. Examples of the solvent include alcohols such as methanol, ethanol, isopropanol and butanol; aliphatic hydrocarbons such as n-hexane, octane and cyclohexane; aromatic hydrocarbons such as benzene, toluene and xylene; halogenated hydrocarbons such as dichloromethane, dichloroethane, carbon tetrachloride and chlorobenzene; ethers such as dimethyl ether, diethyl ether, tetrahydrofuran, ethylene glycol dimethyl ether and diethylene glycol dimethyl ether; ketones such as acetone, methylethylketone and cyclohexanone; esters such as ethyl acetate and methyl acetate; dimethylformamide; and dimethyl sulfoxide. These solvents may be used singly or as a mixture of at least two compounds. The solid concentration of the coating solution may be generally 5 to 50%.

In the case of the laminated photosensitive material, the charge generating agent (CGM) may preferably be contained in an amount of from 30 to 90% by weight, especially from 40 to 80% by weight, based on the solid content of the charge generating layer (CGL) in an amout of as small as possible and in a range which does not lower the sensitivity. The amount of the charge transporting agent (CTM) should be 20 to 70% by weight, especially 30 to 60% by weight, based on the solid content of the charge transporting layer (CTL) in an amount of as small as possible and in a range which does not lower the sensitivity.

The components of each coated layer apply correspondingly to the components of the single dispersed layer type.

In the case of the base plate/CGL/CTL photosensitive layer, CGL generally has a thickness of 0.1 to 2.0 $\mu$m, and CTL has a thickness of 5 to 40 $\mu$m, especially 10 to 30 $\mu$m, and is provided in a layer which is as thick as possible and in a range which does not lower the sensitivity or increase the residual potential.

In the case of the base plate/CTL/CGL, CTL should have a thickness of 5 to 40 $\mu$m, especially 10 to 30 $\mu$m, in a layer which is as thick as possible and within a range which does not lower the sensitivity or increase the residual potential. On the other hand, CGL should preferably have a thickness of 0.1 to 2.0 $\mu$m. Furthermore, a known protective layer may be provided on the CGL.

[Electrophotographic process and the image forming apparatus]

In the electrophotographic process using the photosensitive material of this invention, an electrostatic latent image may be formed by any known arbitrary process, for example by uniformly charging the photoelectroconductive layer on an electroconductive base plate, and imagewise light-exposing the charged photoelectroconductive layer to form the electrostatic latent image. The charging of the photosensitive layer may be carried out positively. The electrostatic latent image may be a positive image in the case of an ordinary copying, or it may be a negative image in the case of laser exposure. The photosensitive material of this invention is especially suitable for reversal development, and therefore, the electrostatic latent image is most preferably a negative image.

In development by using the photosensitive material of this invention, the toner is charged by means of stirring to form a thin layer of the charged toner on the development roller, and the thin layer of the toner is contacted to carry out the development.

Figure 2:
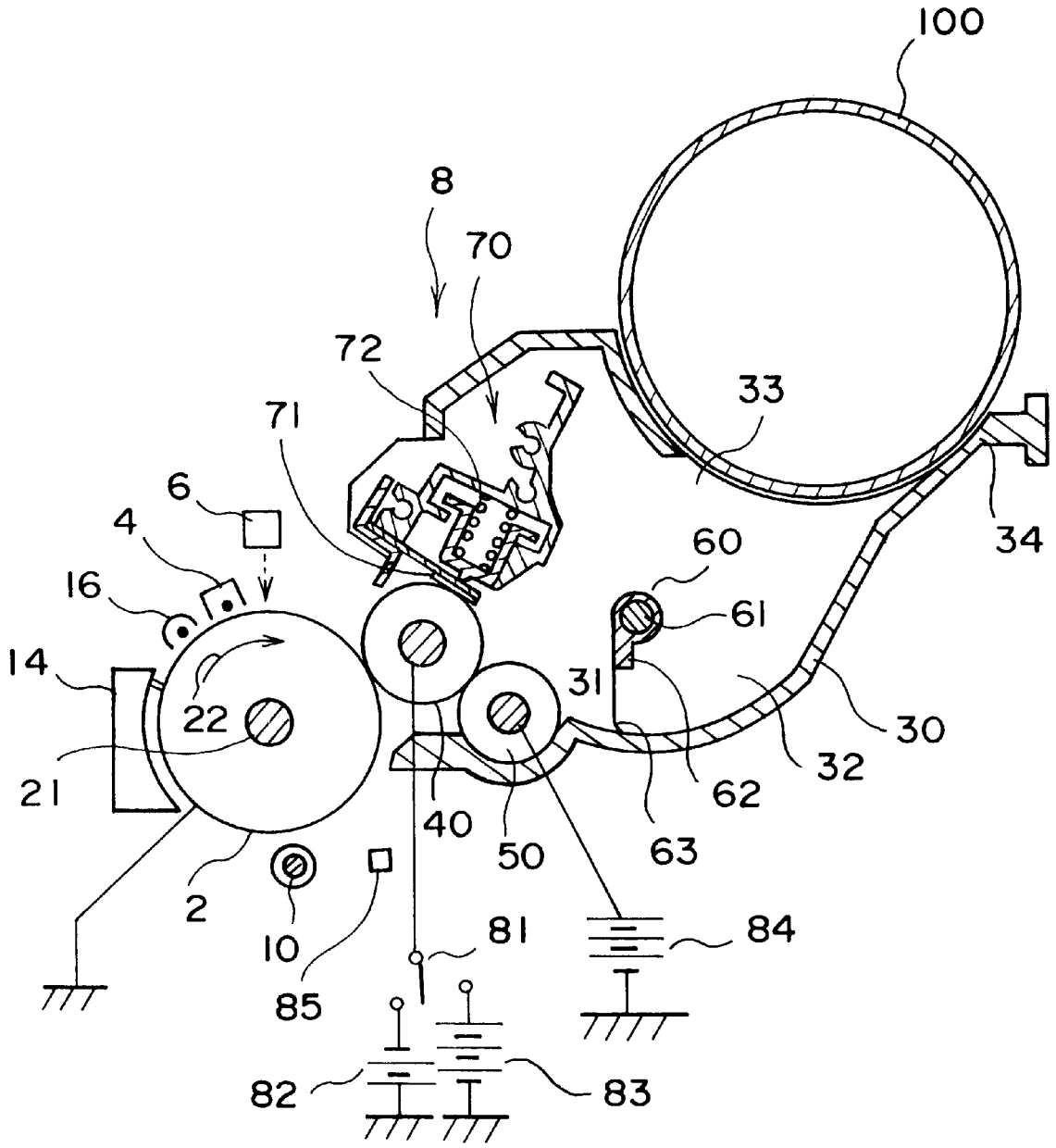
FIG. 2 is a side elevation of the image forming apparatus using the photosensitive material of this invention.

In FIG. 2 showing one example of the image forming apparatus using the photosensitive material of this invention, the photosensitive drum 2 is supported by a rotating shaft 21 and can be driven to rotate in a clockwise direction 22. Around the photosensitive drum 2, a charging means 4, a laser optical apparatus 6, a developing means 8, a transfer roller 10, a cleaning means 14 and a charge-eliminating lamp 16 are arranged.

The developing means 8 is composed of a developing roller 40, a supply roller 50, a stirring and transferring means 60 and a toner layer regulating means 70 provided within a development housing 30. The development housing 30 is provided with a development chamber 31 and a stirring chamber 32, and on its upper portion, a toner cartrige mounting portion 34 having an opening 33, and a toner cartrige 100 is mounted on the mounting portion.

The developing roller 40 is formed from an electroconductive elastomer such as a polyurethane rubber containing an conducting agent, and its surface roughness is adjusted to a 10 point average roughness Rz according to JIS B 0601 of 5.0 to 12.0. The electroconductive elastomer has a volume inherent resistivity value of $10^6$ to $10^9$ Ω.cm. The resistance value of the developing roller is measured when the developing roller is laid on an electroconductive flat plate and a direct current voltage of +200 V is applied between a shaft and a flat plate by adjusting the voltage of the flat plate side to 0 V. For example, the developing roller used in an example shown below has a volume resistivity value of 50 $-2.5\times10^7$ Ω.cm (the load was only the own weight of the roller). This developing roller 40 is pressed against the photosensitive drum 2 at the opening portion of the development chamber 31. Furthermore, a development bias voltage can be applied to the developing roller 40 through its shaft.

The supply roller 50 is formed from an electroconductive elastomer such as polyurethane foamed silicone rubber containing an electroconductive agent. Its hardness becomes smaller than the hardness of the developing roller 40, and the electroconductive elastomer has a volume inherent resistivity of $10^6$ to $10^9$ Ω.cm. This supply roller 50 is provided in the development chamber 31 so that it is parallel to the developing roller 40 and it is press-contacted with the developing roller. A voltage enabling the transfer of the toner composition to the developing roller 40 may be applied to the supply roller 50 through its shaft.

The stirring and transferring means 60 are provided with a rotating shaft 61, a stirring member 62 mounted on the rotating shaft 61, and a stirring sheet member 63 composed of an elastic material of which a base end portion is mounted on the stirring member 62. The stirring sheet member 63 is formed from a resin sheet havng elasticity such as polyethylene terephthalate (PET). This stirring sheet member 63 rotates in a clockwise direction in FIG. 2, and contacts the bottom portion of the housing 30 and the supply roller 50.

The toner layer regulating means 70 is provided with a blade 71 and a press spring 72 for pressing the blade 71 against the developing roller 40 to regulate the thickness or the amount of the toner layer on the developing roller 40.

Generally, in the development apparatus using a non-magnetic one-component toner, in a region on a side contacting the developing roller, the supply roller and the toner layer regulating means, toner blocking occurs and the fluidity of the toner becomes insufficient, and the supply of the toner to the development region tends to become insufficient. In this apparatus shown in FIG. 2 the toner blocking is prevented and the fluidity of the toner can be increased by using the above stirring and transferring means.

The stirring and transferring means discharge the toner remaining in the above mentioned region from the above region, and feed a new toner to this region, whereby the fluidity of the toner is increased and the supply of the toner is carried out smoothly and exactly.

The developing roller 40 is switchably connected to a minus output terminal of a power supply 82 and a plus output terminal of a power supply 83 via switch 81, and on the other hand, the supply roller 50 is connected to the plus output terminal of a power supply 84. Detecting means 85 for detecting the tip of a transfer paper are provided in a transfer paper passage for passing the transfer roller 10. A switch 81 is connected to the power supply 82 at the time of begining the operation, and a minus voltage is applied to the developing roller 40. When the tip of the transfer paper is detected by the detecting means 85, the switch 81 is switched to the power supply 83, and a plus voltage is applied to the developing roller 40.

Figure 3:
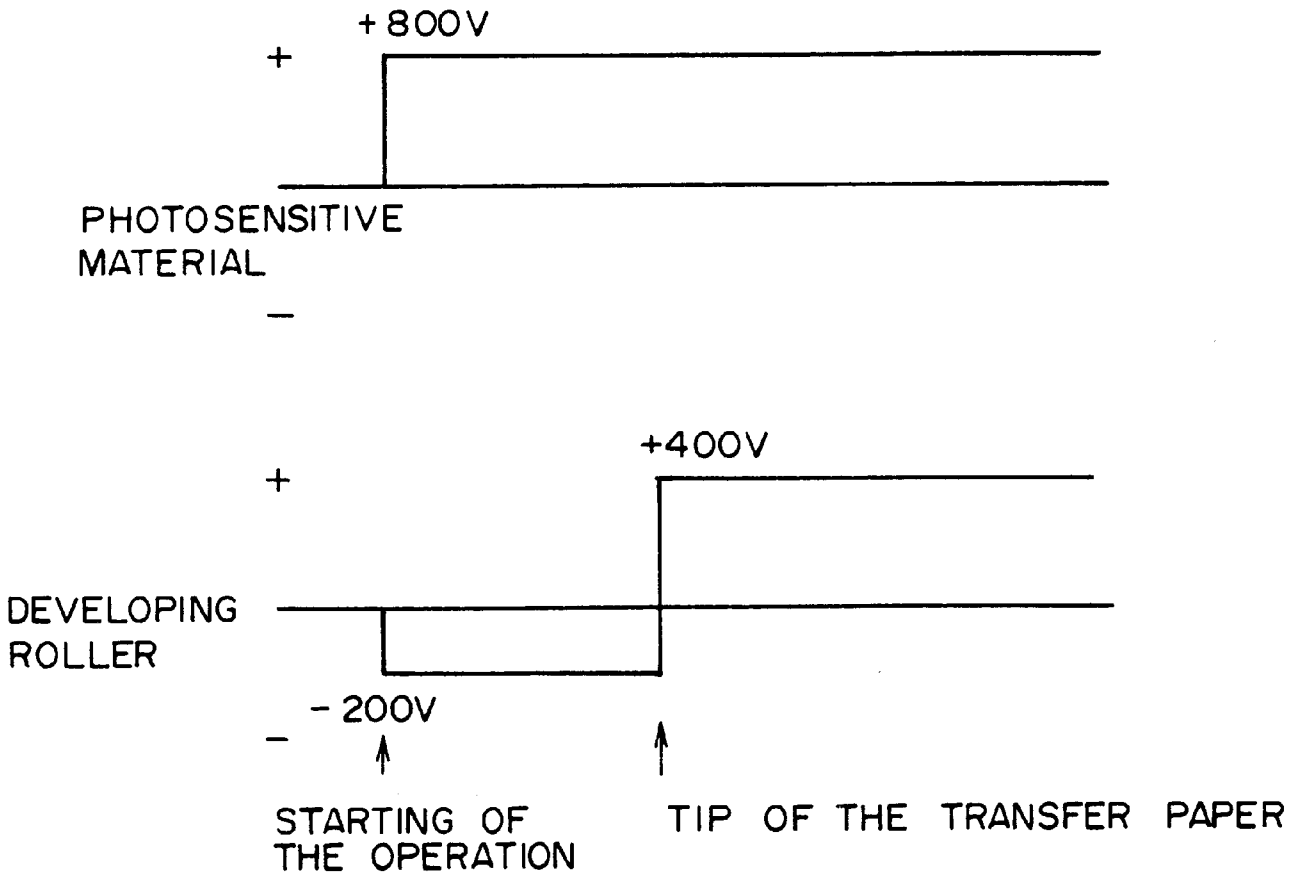
FIG. 3 is a timing chart showing the surface potential of the photosensitive material and the applied voltage on the developing roller.

FIG. 3 shows a timing chart of the applied voltage to the developing roller 40 and the charging of the charging means 4 to the photoelectric material 2.

The voltage (VR) which will be applied to the developing roller 40 in an initial period has an inverse polarity to the surface potential of the photosensitive material 2, and as an absolute value, an electric voltage of 50 to 400 V is applied effectively to prevent the occurrence of a transverse black stripe. On the other hand, a voltage (VRR) after switching of the polarity of the developing roller 40 has the same polarity as the surface potential (dark portion potential) of the photosensitive material 2, and it is effective to apply a bias voltage of 0.2 to 0.8 times, especially 0.3 to 0.7 times, in order to prevent the fogging and form an image having a high image density.

Figure 4:
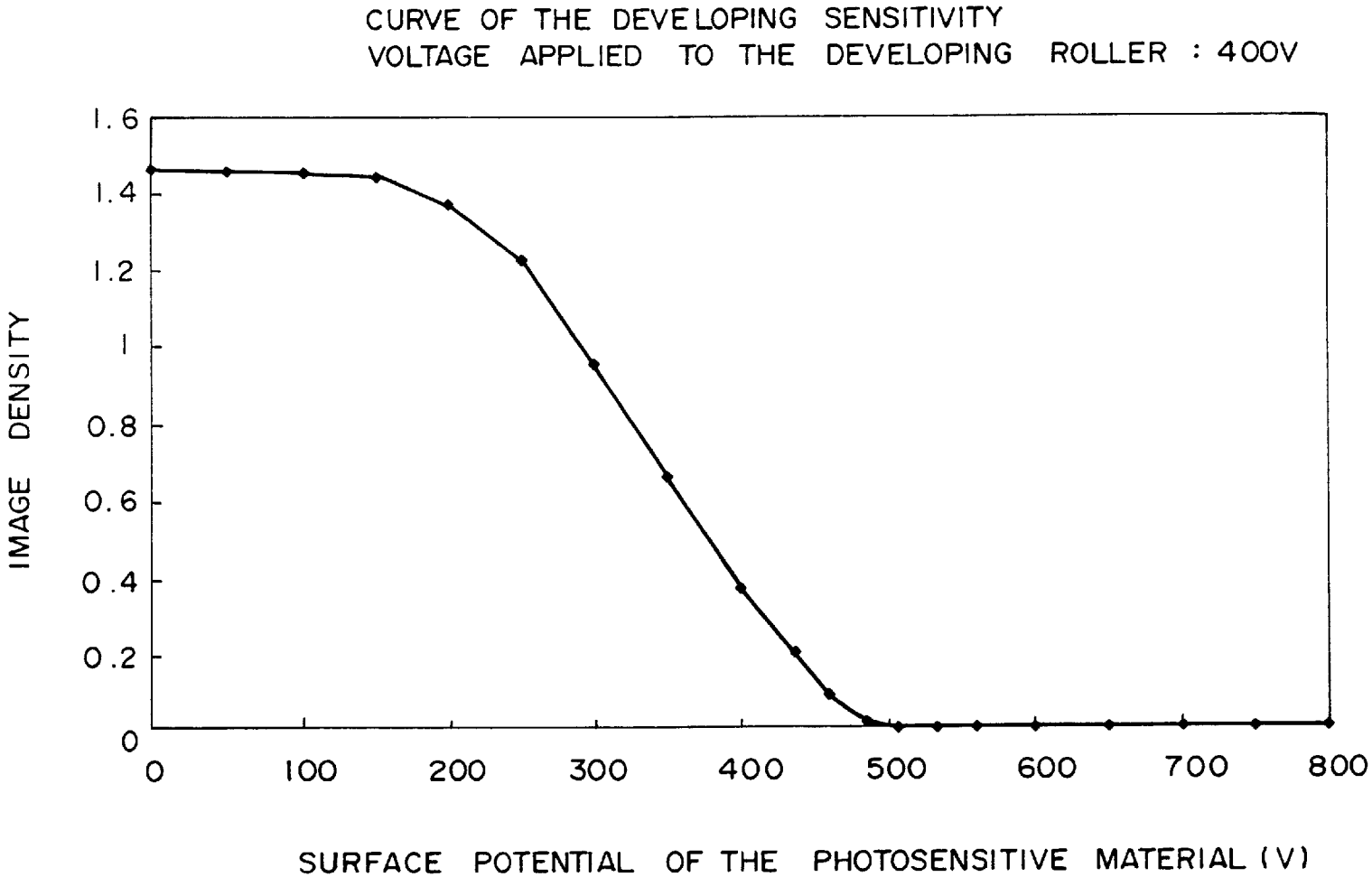
FIG. 4 is a development sensitivity curve of the photosensitive material A.

FIG. 4 is a development sensitivity curve of the photosensitive material (A) of FIG. 1. When the initial period voltage (VR) to be applied to the developing roller 40 is −200 V, the surface potential (VD) immediately after the passage of the development portion (the contacting portion between the photosensitive material and the developing roller) becomes about 570 V (see FIG. 1). From FIG. 4, if the surface potential of the photosensitive material is 570 V, the image density becomes zero. It can be found that the occurrence of a transverse black stripe at the tip of the transfer paper or fogging is completely suppressed.

As stated previously, the developing roller 40 is press-contacted with the photosensitive drum 2, its pressure-contacting force (linear pressure) is preferably 0.05 to 1 Kg/dm, especially from 0.08 to 0.5 Kg/dm, and the developing roller 40 feeds the toner to this pressure-contacting portion to perform development. It is preferred that in the development, the developing roller 40 is rotated in the same direction as the photosensitive material drum at the nipping position. Preferably, the peripheral speed of the developing roller 40 may be 1.2 to 3 times, especially 1.5 to 2.5 times, the peripheral speed of the photosensitive material drum 2.

When the pressure-contacting force is lower than the above-mentioned range, or the peripheral speed of the developing roller 40 is lower than the above-mentioned range, it is difficult to increase the image density sufficiently, and cleaning tends to be not performed sufficiently in a dark place in the photosensitive material. When the pressure-contacting force and the peripheral speed are prescribed within the above ranges, cleaning of the surface of the photosensitive material drum 2 is effectively carried out by means of the developing roller. As circumstances require, it is possible to form an image without providing the cleaning means 14.

When the pressure-contacting force is higher than the above-mentioned range, or the peripheral speed of the developing roller 40 is larger than the above-mentioned range, the amount of cutting of the photosensitive material increases, and the life of the photosensitive material tends to be shortened.

In the development apparatus shown in FIG. 2, a bias voltage is also applied to the supply roller 50 as has been stated above. The bias voltage applied to the supply roller 50 has the same polarity as the bias voltage applied to the devloping roller 40 and is a voltage higher than that applied to the developing roller 40 by about 10 to 200 V. This is preferred to perform the transfer of the toner smoothly from the supply roller 50 to the developing roller 40.

The thickness of the toner layer on the developing roller 40 is regulated by the blade 71. But it is preferred that about two times the particle diameter should be formed, namely about two layers of the toner may be formed.

[Non-magnetic one-component toner]

As a non-magnetic one-component toner, coloring toners having electroscopicity and fixability are used. These toners are generally obtained by dispersing a coloring pigment, a charge controlling agent, or a releasing agent for fixation in a binder agent resin to form particles having a particle diameter of 1 to 30 $\mu$m, especially 5 to 25 $\mu$m.

As the binder agent resin, thermoplastic resins, and thermosetting resins which are uncured or initial condensation products may be used. Suitable examples of such thermoplastic and thermosetting resins include styrene type polymers, acrylic polymers, styrene-acrylic polymers, polyester type resins, polyamide type resins, olefin resins such as ionomers, chlorine-containing polymers such as a vinyl chloride resin, modified or unmodified polyurethanes, modified or unmodified epoxy resins, modified or unmodified silicone resins, modified or unmodified phenol resins, petroleum resins, and modified or unmodified alkyid resins. These resins may be selected and used according to the method of fixation and the development conditions.

As binder resins for the toner, styrene type polymers, acrylic polymers, and styrene-acrylic polymers are preferably exemplified. These resins afford advantages in that the toner is produced easily by a polymerization method, or a pulverization classification method, and the controlling of fixability is easy. These polymers generally have a weight average molecular weight of 30000 to 200000, especially 50000 to 150000, and those having a molecular weight distribution (Mw/Mn) of 5 to 100 are suitable. In view of the offset preventive property, those having a plurality of peaks in the molecular weight distribution are useful.

Other preferred examples of binder resins for the toner include low melting aromatic polyester resins. These polyesters are derived from acid components and alkylene oxide adducts of bisphenols, or further from alcohol components. Three to 30 equivalent % of the acid or alcohol component is an acid component or alcohol component having at least trivalence, and the remainder is a divalent acid component or alcohol component. The polyesters may contain a unit of an alkylene oxide adduct of a bisphenol in an amount of 30 to 80% by weight based on all.

Examples of the divalent acid component include terephthalic acid, isophthalic acid, p-β-oxyethoxybenzoic acid, diphenoxyethan-4,4'-dicarboxylic acid, 5-sodiumsulfoisophthalic acid, hexahydroterephthalic acid, naphthalene-dicarboxylic acid, adipic acid and sebacic acid. On the other hand, examples of trivalent polybasic acid include trimellitic acid, pyromellitic acid, butanetricarboxylic acid and hexanetricarboxylic acid.

Examples of the dihydric alcohol component include ethylene glycol, propylene glycol, 1,4-butanediol, neopentyl glycol, 1,6-hexylene glycol, diethylene glycol, triethylene glycol and cyclohexanedimethanol. Examples of the alcohol component having at least trivalence are glycerine, trimethylolpropane, pentaerythritol and sorbitol.

Examples of the alkylene oxide adducts of bisphenol are ethylene oxide adducts or propylene oxide adducts of bisphenol A, bisphenol F and bisphenol B.

Preferably, the polyesters have an acid value of not larger than 20, especially not larger than 10.

Coloring agents to be included in the resins include inorganic or organic pigments or dyes shown below used singly or a mixture of at least two above-mentioned pigments or dyes, but are not limited to these exemplified compounds. They include carbon blacks such as furnace black and channel black; rutile-type or anatase-type titanium dioxide; Phthalocyanine Blue; Pthalocyanine Green; Cadium Yellow; Molybdenum Orange; Pyrazolone Red; and Fast Violet B.

The above pigments may be used in an amount of 1 to 20 parts by weight, especially 5 to 12 parts by weight, per 100 parts by weight of the resin medium for fixation.

Examples of the releasing agent for heat fixation include various waxes, and low molecular weight olefin resins. The low molecular weight olefin resins may have a number average molecular weight (Mn) of 1000 to 10000, especially 2000 to 6000.

Such olefin resins preferably include polypropylene, polyethylene and a propylene-ethylene copolymer. However, polypropylene is especially preferred.

The releasing agent for heat fixation is used in an amount of 1 to 10 parts by weight, especially 2 to 5 parts by weight, per 100 parts by weight of the resin medium for fixation.

Examples of the charge controlling agent include any desired known arbitrary charge controlling agents, for example, oil-soluble dyes such as Nigrosine base (CI 50415), Oil Black (CI20150) and Spiron Black; 1:1 type or 2:1 type metal complex salt dyes; salicylic acid, or metal salts of its derivative; metal salts of naphthenic acid; fatty acids or soap; and resin acid soap. Since the photosensitive material of this invention is suitable for reversal development using a positively charged non-magnetic toner, Nigrosine is preferred as the charge controlling agent.

The charge controlling agent is used in an amount of 0.5 to 10 parts by weight, especially 0.5 to 3 parts by weight, per 100 parts by weight of the resin medium for fixation.

As toner particles, it is preferred to use a toner having a uniform particle size distribution such that ½ or below of the average particle diameter becomes 20% by weight or below of the entire volume. The shape of the particles may be irregular produced by a melting kneading and pulverizing method, or spherical produced by a dispersing or suspending polymerization method, or the irregular toner may be converted to a molten spherical shape in a heated current.

In the case of the pulverization and classification method, the above-mentioned toner components are premixed by a mixer such as a Henschel mixer, the mixture is kneaded by using a kneading machine such as a biaxial extruder, the kneaded composition is cooled, the cooled composition is pulverized, and classified to form a toner. Of course, the irregular-shaped toner is melted in a heated current to form a spherical toner.

A fine powder as a fluidity-increasing agent is externally added to the non-magnetic one-component toner particles. The resulting toner composition may be used to develop an electrostatic latent image. Examples of the fluidity-increasing agent include fine particles of amorphous silica, fine particles of alumina, fine particles of titanium dioxide and fine particles of acrylic resin which are used singly or a mixture of at least two compounds. The compounding amount of the fluidity-increasing agent may be in a range of 0.01 to 2.0 parts by weight per 100 parts by weight of the toner.

[Examples]

The present invention will be illustrated by the following examples.

Preparation of the photosensitive material

<Photosensitive Material A>

Five parts by weight of X-type metal-free phthalocyanine as a charge generating agent, 40 parts by weight of N,N'-bis(o, p-dimethylphenyl)-N,N'-diphenylbenzidine as a hole transporting agent, 40 parts by weight of 2-t-butyl-carbonyl-3-phenyl-1,4-naphthoquinone as an electron transporting agent, 100 parts by weight of bisphenol Z-type polycarbonate as a binder resin, and 800 parts by weight of tetrahydrofuran as a solvent were mixed and dispersed in a ball mill for 50 hours to form a coating solution for a single layer-type photosensitive material. The coating solution was coated on an aluminum tube (Φ: 16 mm), and dried with hot air at 100° C. for 60 minutes to form a single layer type photosensitive material for electrophotography having a thickness of 25 μm.

<Photosensitive Material B>

Eight parts by weight of X-type metal-free phthalocyanine as a charge generating agent, 40 parts by weight of N,N'-bis(o,p-dimethylphenyl)-N,N'-diphenylbenzidine as a hole transporting agent, 40 parts by weight of 2-t-butyl-carbonyl-3-phenyl-1,4-naphthoquinone as an electron transporting agent, 100 parts by weight of bisphenol Z-type polycarbonate as a binder resin and 800 parts by weight of tetrahydrofuran as a solvent were mixed and dispersed in a ball mill to prepare a coating solution for a single layer-type photosensitive material. The coating solution was coated on an aluminum tube (Φ: 16 mm), and dried with hot air at 100° C. for 60 minutes to prepare a single layer-type photosensitive material for electrophtography having a thickness of 15 μm.

<Photosensitive Material C>

The same coating solution for a single layer-type photosensitve material as used in the preparation of the photosensitive material A was coated on an aluminum tube (Φ: 16 mm) and dried with hot air at 100° C. for 60 minutes to form a single layer-type photosensitive material for electrophotography having a film thickness of 21 μm.

Experimental Example 1

(Evaluation of the surface potential decay characteristics of the photosensitive material)

Mita Industrial Co., Ltd. Manufactured Plain Paper FAX "TC-720" was remodeled to form the machine having the same structure as in FIG. 2. Each of photosensitive materials A, B and C prepared as shown below was mounted alternately on the above machine, and each photosensitive material was charged to 800 V under the following conditions. The surface potential (VD) of the photosensitive material immediately after passage through a development portion (the contacting portion between the photosensitive material and the developing roller) was measured by variously changing the bias voltage VR (negative polarity) to be applied to the developing roller.

(Measuring conditions)

Developing roller:

Roller diameter: Φ16 mm

Peripheral speed: 2.0 times the peripheral speed of the photosensitive material

Rotating direction: The same direction as the photosensitive material at the nipping position Toner layer: none Pressure of contact with the photosensitive material: 0.3 kg/dm (Measuring method)

The surface potential of the photosensitive material after contacting the developing roller was measured by arranging an exclusive probe connected to a surface electrometer Model 344 manufactured by TRek Co., Ltd. on a downstream side of the developing roller, and measuring the potential of a white paper portion (dark potential) of the photosensitive material by using this probe after contacting the developing roller. The results of measurement are shown in FIG. 1.

Experimental Example 2

(Fogging at the tip/black stripe confirmation test)

By using the remodeled machine on which each of the photosensitive materials A, B and C used in Experimental Example 1 was mounted, an image was formed by the reversal development method. At this time, in accordance with the timing chart shown in FIG. 3, the surface potential of the photosensitive material was charged to +800 V by a charging means 4, and the voltage applied to the developing roller was switched from −200 V to +400 V by detecting the tip of the transfer paper with a detecting means 85 to change the power supply by switching the switch 81. The following toner was used.

Type of the toner: positively charged non-magnetic one-component toner binder resin: styrene-acrylic copolymer coloring agent: carbon black charge controlling agent: Nigrosine average particle diameter: 10 μm The conditions of the structure and the peripheral speed of the developing roller are quite the same as in Experimental Example 1. A portion of the photosensitive material corresponding to a portion of 3 mm in the transferring direction of a tip portion of the transfer paper was preset so that it had a white paper portion without performing laser exposure.

Fogging or a black stripe in the tip of the transfer paper occured by the experiment performed in the above manner was confirmed. The results are as follows.

| Image (3 mm in the tip of the transfer paper) | |
|---|---|
| Photosensitive material A | White paper |
| Photosensitive material B | Black stripe occurred |
| Photosensitive material C | White paper |

Any photosensitive materials having characteristics which satisfies the formula (1) shown in FIG. 1 pose no problems in the occurrence of fogging or a black stripe in the tip of the transfer paper if such photosensitive materials are used in an image forming apparatus having a developing roller contacting the photosensitive materials.

According to the photosensitive material of this invention, the photosensitive material is constituted so that the relation between the surface potential (VD) immediately after passage of the development portion and the initial voltage (VR) to be applied to the developing roller will satisfy the formula (1). When this photosensitive material is used in an image forming apparatus having a developing roller which performs development in contact with the photosensitive material, a transverse black stripe in the tip of the transfer paper which occurs at a time of switching over the voltage to be applied to the developing roller is prevented. As a result, it is possible to form an image having excellent image quality and image density. At the same time, it is not necessary to perform a multistep controlling of applying a voltage. Thus, the construction of the image forming apparatus can be simplified, and the cost of the apparatus can be curtailed.

What is claimed is:

1. A photosensitive material for electrophotography to be provided in contact with a developing roller, which photosensitive material has a surface potential decay characteristic in which when the photosensitive material is charged to a surface potential of 800 V, and the photosensitive material is contacted with the developing roller to which a voltage (VR) is applied, the surface potential (VD) of the photosensitive material after contacting is represented by the following formula (1):

$$VD \geqq 800 \times \mathrm{EXP}\ (0.00235 \times VR) \quad (1).$$

2. A photosensitive material of claim 1 wherein the photosensitive material is a positively charged organic photosensitive material, the polarity of the surface potential of the photosensitive material is positive and the polarity of the voltage (VR) applied to the developing roller is negative.

3. A process for forming an image, which comprises mainly charging the surface of the photosensitive material positively, imagewise light-exposing to form an electrostatic image on the surface of the photosensitive material, forming a negative image by a non-magnetic toner supplied to a developing roller provided in contact with the photosensitive material, and transferring the negative image to a transfer paper;

wherein the photosensitive material has a surface potential decay characteristic in which when the surface of the photosensitive material is charged to 800 V and is contacted with the developing roller to which a negative voltage (VR) is applied, after contacting the developing roller, the surface potential (VD) of the photosensitive material is represented by the following formula (1)

$$VD \geqq 800 \times \mathrm{EXP}\ (0.00235 \times VR)$$

before forming the negative image by the nonmagnetic tonor, a negative bias voltage is applied to the developing roller, and the negative image is formed by the non-magnetic toner in a condition in which a positive bias voltage is applied to the developing roller.

4. A process for forming an image according to claim 3 wherein the developing roller is press-contacted with the surface of the photosensitive material at a linear pressure of 0.05 to 1 kg/dm.

5. A process for forming an image according to claim 3 wherein the positive bias voltage to be applied to the developing roller is 0.2 to 0.8 times the potential of the dark portion of the photosensitive material.

* * * * *